US005106414A

United States Patent [19]

Kunichika et al.

[11] Patent Number: 5,106,414

[45] Date of Patent: Apr. 21, 1992

[54] DAMPENING WATER COMPOSITION FOR LITHOGRAPHIC PRINTING AND ADDITIVE FOR DAMPENING WATER

[75] Inventors: Kenji Kunichika; Hiroshi Matsumoto; Toshio Uchida, all of Shizuoka, Japan

[73] Assignee: Fuji Photo Film Co., Ltd., Minami-ashigara, Japan

[21] Appl. No.: 332,728

[22] Filed: Apr. 4, 1989

[30] Foreign Application Priority Data

Apr. 7, 1988 [JP] Japan ..... 63-86176
May 19, 1988 [JP] Japan ..... 63-122594

[51] Int. Cl.[5] ..... B41M 5/00; B41N 3/00

[52] U.S. Cl. ..... 106/2; 101/465; 101/466

[58] Field of Search ..... 106/2, 451; 568/624; 252/174.21; 101/465, 466

[56] References Cited

U.S. PATENT DOCUMENTS 3,877,372 4/1975 Leeds ..... 101/451
4,560,410 12/1985 Burns et al. ..... 101/451
4,854,969 8/1989 Bassemir et al. ..... 106/2
4,865,646 7/1989 Egberg ..... 106/2

FOREIGN PATENT DOCUMENTS 0269760 6/1988 European Pat. Off. .

OTHER PUBLICATIONS

European Search Report.

*Primary Examiner*—William R. Dixon, Jr.
*Assistant Examiner*—C. Melissa Bonner
*Attorney, Agent, or Firm*—Burns, Doane, Swecker & Mathis

[57] ABSTRACT

A dampening water composition for lithographic printing which comprises 0.1 to 5% by weight of at least one member selected from the group consisting of monoalcohols or diols of alkanes or alkenes having 5 to 11 carbon atoms, to which 1 to 10 moles of ethylene oxide and/or propylene oxide are added. The dampening water composition is not toxic, has not a possiblity of causing a fire and pollution of working atmosphere and, therefore, the use of a local exhaust installation is not necessary. Moreover, it is excellent in characteristics as dampening water such that it does not cause contamination of metering roll, has good bleeding properties, emulsifying properties and stability in continuous processing as well as low foaming properties. Thus, the composition makes printing operation quite stable.

14 Claims, No Drawings

DAMPENING WATER COMPOSITION FOR LITHOGRAPHIC PRINTING AND ADDITIVE FOR DAMPENING WATER

BACKGROUND OF THE INVENTION

The present invention relates to a dampening water composition for lithographic printing as well as an additive for dampening water for lithographic printing, which allows for a lithographic printing plate to provide printed matters having good quality by adding to the dampening water.

Lithographic printing technique makes the best use of the properties of water and an oil such that they are essentially incompatible with one another. The printing surface of a lithographic printing plate comprises areas which receive water and repel an oil ink and those which repel water and receive an oil ink, the former serving as non-image areas and the latter serving as image areas. The non-image areas become damp with dampening water used in lithographic printing which contains a desensitizing agent to thus enhance the difference in surface chemical properties between the image areas and the non-image areas and hence to increase both the ink repellency of the non-image areas and the ink receptivity of the image areas.

As such dampening water, there have generally been known conventionally aqueous solutions containing such inorganic substances as alkali metal salts or ammonium salt of bichromic acid, phosphoric acid or salts thereof such as ammonium salt, or such a colloidal substance as gum arabic or carboxymethyl cellulose (CMC).

However, it is difficult to uniformly dampen the non-image areas of lithographic printing plates with the dampening water containing such a desensitizing gum and for this reason, the resultant printed matters are sometimes contaminated and a substantial skill in controlling the feed rate of the dampening water is required.

To overcome such disadvantages, there has been proposed the Dahlgren dampening system in which an aqueous solution containing about 20 to 25% of isopropyl alcohol is used as dampening water. This method provides a variety of advantages concerning workability and accuracy of printed matters, such that the wettability of the non-image areas is improved, that the amount of the dampening water can be reduced, that it is easy to control the balance between feed rates of printing ink and dampening water, that the amount of water emulsified into the printing ink is lowered and that the transfer of printing ink to the blanket is improved.

However, isopropyl alcohol is apt to evaporate and, therefore, the use of a special device is required for keeping the concentration thereof constant. This is unfavorable from the economical point of view. Moreover, isopropyl alcohol gives out bad smell and is toxic and thus the use thereof is not favorable in view of the pollution of working atmosphere.

In addition, even if the dampening water containing isopropyl alcohol is applied to offset printing in which a dampening molleton roller is commonly used, isopropyl alcohol evaporates from a roller surface and the printing plate surface. Therefore, it cannot show its own effects.

Moreover, the pollution with industrial waste has become of a matter of great concern, the regulation with respect to discharge of chromium ions in waste water becomes more and more severer and there is a tendency of controlling the use of organic solvents such as isopropyl alcohol from the viewpoint of safety and hygiene. For this reason, it has been desired to develop desensitizing gums or dampening water free of such a compound.

Under such circumstances, Japanese Patent Publication for Opposition Purpose (hereunder referred to as "J. P. KOKOKU") Nos. 55-25075, 55-19757 and 58-5797 disclose compositions containing a variety of surfactants which can only slightly reduce the surface tension of water. In general, the dampening water should have a surface tension ranges from 35 to 50 dyn/cm. Therefore, if these compositions are used as dampening water, it is necessary to substantially increase the concentration of surfactants in such a desensitizing gum or dampening water. Furthermore, water is adhered to an ink film or an ink spreads over the surface of water because of vigorous movement of ink and/or water existing below an ink roll, a printing plate and a roll for supplying dampening water which rotate at a high speed, during the practical lithographic printing. However, combinations of surfactants disclosed in the foregoing methods explained above are insufficient for completely solve these problems. Besides, these dampening water containing such surfactants easily cause foaming during pumping and/or stirring thereof.

In addition, U.S. Pat. No. 3,877,372 discloses a solution containing a mixture of ethylene glycol monobutyl ether and at least one of hexylene glycol and ethylene glycol. U.S. Pat. No. 4,278,467 discloses a dampening water containing at least one member selected from the group consisting of n-hexoxyethylene glycol, n-hexoxydiethylene glycol, 2-ethyl-1,3-hexanediol, n-butoxyethylene glycol acetate, n-butoxydiethylene glycol acetate and 3-butoxy-2-propanol. Japanese Patent Unexamined Publication (hereunder referred to as "J.P. KOKAI") No. 57-199693 (U.S. Pat. No. 4,560,410) discloses dampening water containing 2-ethyl-1,3-hexanediol, Ester diol 204(viz., $HOCH_2C(CH_3)_2CH_2OCOC(CH_3)_2CH_2OH$), Hexyl Cellosolve or Hexyl Carbitol and at least one member selected from the group consisting of completely water-soluble propylene glycol, ethylene glycol, dipropylene glycol, diethylene glycol, hexylene glycol, triethylene glycol, tetraethylene glycol, tripropane glycol and 1,5-pentanediol. As these dampening water compositions do not contain isopropyl alcohol, they are preferable in view of safety and hygiene. However, the wettablility thereof with respect to non-image areas of a lithographic printing plate comprising an anodized aluminum substrate, during printing operation is not sufficient and it is sometimes observed that the non-image areas are contaminated, in particular, during high speed printing operation and that so-called ink spreading of half dot image portions, i.e., phenomenon wherein the shape of half dot images is abnormally deformed, is enlarged and is uneven, is caused. Moreover, 2-ethyl-1,3-hexanediol has not sufficient solubility in water and thus the use thereof is unfavorable to obtain a concentrated dampening water or an additive for dampening water having a high concentration.

SUMMARY OF THE INVENTION

Accordingly an object of the present invention is to provide a dampening water composition for lithographic printing, which does not exhibit toxicity and disadvantages associated with the foregoing conventional dampening water, which makes it possible to easily control the feed rate of the dampening water during the printing operation without professional skill and which has excellent properties as the dampening water.

Another object of the present invention is to provide an additive for dampening water, having similar properties.

Under such circumstances, the inventors of this invention have conducted various studies on dampening water for lithographic printing and have found that the foregoing problems can effectively be solved by incorporating a specific compound to dampening water composition in a specific amount. Thus the inventors have completed the present invention.

Consequently, the present invention relates to a dampening water composition for lithographic printing which comprises 0.1 to 5% by weight of at least one compound selected from the group consisting of monoalcohols or diols of alkanes or alkenes having 5 to 11 carbon atoms, to which 1 to 10 moles of ethylene oxide and/or propylene oxide. per molecule, are added.

According to another aspect of the present invention, an additive for dampening water used in lithographic printing is provided and it comprises not less than 1% by weight of at least one compound selected from the group consisting of the foregoing compounds.

DETAILED EXPLANATION OF THE INVENTION

The compounds used in the dampening water composition of the invention are those obtained by adding, by an addition polymerization reaction, 1 to 10 moles of ethylene oxide and/or propylene oxide to linear, branched or cyclic alkanes or alkenes having 1 to 2 alcoholic hydroxyl groups and having 5 to 11 carbon atoms according to an ordinary synthetic method. The foregoing problems of contamination of non-image areas and ink spreading of half dot image portions of printing plates comprising an anodized aluminum plate as a substrate during printing can effectively be solved by employing dampening water containing 0.1 to 5% by weight of at least one such compound.

When a printing press in which dampening water is continuously supplied, represented by the Dahlgren dampening system is used, surface tension of dampening water used preferably ranges from 30 to 50 dyn/cm. Therefore, the starting materials of the compounds used in the invention should have a carbon atom number ranging from 5 to 11. This is because if it is not more than 4, such derivatives of alkanes or alkenes show low ability of reducing surface tension, while if it is not less than 12, the resultant alkane or alkene derivatives cause remarkable foaming which leads to contamination of printed matters during high speed printing operation.

Examples of such alkanes or alkenes having 5 to 11 carbon atoms and 1 to 2 alcoholic hydroxyl groups are n-amyl alcohol, isoamyl alcohol, secondary amyl alcohol, tertiary amyl alcohol, 3-methoxybutyl alcohol, 1-penten-3-ol, n-hexyl alcohol, 2-methyl-1-pentanol, secondary hexyl alcohol, 2-ethylbutyl alcohol, hexenol, 3-heptanol, heptenol, n-octyl alcohol, octenol, 2-ethylhexyl alcohol, secondary octyl alcohol, nonyl alcohol, 2,6-dimethyl-4-heptanol, n-decanol, decenol secondary undecyl alcohol, cyclohexanol, methyl cyclohexanol, 3,3,5-trimethyl cyclohexanol, 1,5-pentanediol, 2,4-pentanediol, 2,5-hexanediol, 1,6-hexanediol, 1,7-heptanendiol, 2,4-heptanediol, 2-methyl-2,4-pentanediol, 2-ethyl-1,3hexanediol, 1,8-octanediol, 1,9-nonanediol, 1,10-decanediol, pinacol, cyclopetane-1,2-diol, cyclohexane-1,2-diol, cyclohexane-1,4-diol, 2,2-diethyl-1,3-propanediol and 2-butyl-2-ethyl-1,3-propanediol.

Moreover, the compound to which more than 10 moles of ethylene oxide and/or propylene oxide have been added can reduce only slightly surface tension of dampening water when it is added thereto and thus it is necessary to increase the amount of the compound to be added to dampening water. This is economically unfavorable. Further, there is observed deterioration of ink receptivity (incomplete adhesion of ink) due to excessive emulsification of ink and it becomes difficult to obtain good printed matters having a high density.

As the compounds used in the invention, those to which ethylene oxide is exclusively added are preferable. In other words, it is preferred that the molar number of propylene oxide added be lower than that of ethylene oxide. Therefore, if compounds to which only propylene oxide moieties are added are employed, the molar number of propylene oxide added is preferably limited to 1 to 5 moles so that the solubility of the resultant compounds in water is not excessively lowered.

The foregoing object of the present invention can also be achieved by adding at least one compound defined above to the conventional dampening water. In other words, according to another aspect of the present invention, there is provided an additive for dampening water for lithographic printing which comprises not less than 1% by weight of at least one compound selected from the group consisting of those defined above. In this respect, it is preferred to form such an additive for dampening water as a concentrate having a high concentration for the purpose of making, easy, the addition operation and supplementation thereof in the course of printing processes (including automatic supplementation). The additive for lithographic printing of the present invention comprises not less than 1% by weight, preferably not less than 10% by weight of at least one compound selected from the group consisting of those defined above. Since ethylene oxide moieties are added to such compounds, the solubility thereof in water is improved so that solutions containing the same can easily be concentrated.

According to a specific embodiment of the present invention, there is provided a dampening water composition for lithographic printing which comprises 0.1 to 5% by weight of at least one compound selected from the group consisting of those represented by the following general formula (I):

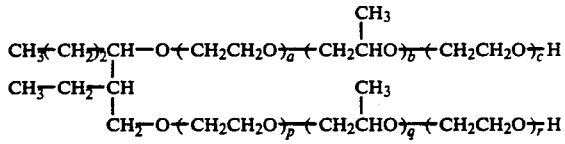

wherein the sum of a, b, c, p, q and r is an integer ranging from 1 to 10 and each of these is an integer ranging from 0 to 10.

These compounds (I) can be produced by adding, by an addition polymerization reaction, 1 to 10 moles of ethylene oxide and/or propylene oxide to 2-ethyl-1,3-hexanediol per molecule as already explained above. Although 2-ethyl-1,3-hexanediol has low solubility in water, its solubility in water is enhanced by the addition of ethylene oxide and/or propylene oxide moieties and as a result, it may be used in the dampening water composition and the additive of the present invention. Thus, these compounds show the same effects as those explained above.

The dampening water composition and the additive for lithographic printing may further contain at least one water-soluble polymer. Typical examples of such polymers include such a natural substance or modified products thereof as gum arabic, starch derivatives, for instance, dextrin, enzyme-modified dextrin, hydroxypropylated enzyme-modified dextrin, carboxymethylated starch and starch phosphate, octenyl succinated starch, alginates or cellulose derivatives, for instance, carboxymethyl cellulose, carboxyethyl cellulose, hydroxyethyl cellulose, methyl cellulose and hydroxypropyl methyl cellulose; and such a synthetic substance as polyvinyl alcohol and derivatives thereof, polyvinyl pyrrolidone, polyacrylamide and copolymers thereof, polyacrylic acid and copolymers thereof, vinyl methyl ether/maleic anhydride copolymer and vinyl acetate/maleic anhydride coplymers. These water-soluble polymers may be used alone or in combination and the amount thereof to be incorporated into the dampening water composition and the additive of the present invention in general ranges from 0.0001 to 5% by weight, preferably 0.003 to 1% by weight on the basis of the total weight of the dampening water composition.

It is in general desirable to use the dampening water having acidic pH ranging from about 3 to 6. This is because the etching action thereof becomes high at a pH of less than 3 and printing durability of the plate is correspondingly lowered. In order to adjust pH to 3 to 6, it is sufficient to add a mineral acid, an organic acid or an inorganic salt to the dampening composition. The amount thereof desirably ranges from 0.001 to 5% by weight. Examples of mineral acids are nitric acid, sulfuric acid and phosphoric acid and examples of organic acids include citric acid, acetic acid, oxalic acid, malonic acid, p-toluenesulfonic acid, tartaric acid, malic acid, latic acid, levulinic acid and organophosphonic acids. These mineral acids, organic acids or inorganic salts may be used alone or in combination.

Alternatively, the dampening water composition of the invention can be used in the alkaline region around a pH range of 7 to 11. The pH value may be adjusted by adding at least one alkaline substance such as alkali metal hydroxides, alkali metal phosphates, alkali metal carbonates or silicates.

In addition to the foregoing components, the dampening water composition of the invention may further comprise a wetting agent capable of suppressing drying to make usability thereof good. Examples of such suitable wetting agents include glycerin, ethylene glycol, propylene glycol, butylene glycol, pentanediol, hexylene glycol, diethylene glycol, triethylene glycol, tetraethylene glycol, sorbitol and pentaerythritol. These wetting agents may be used alone or in combination. The amount thereof is desirably not more than 2.0% by weight.

Besides, the dampening water composition of the invention may further contain at least one chelating agent. Usually, a concentrate of a dampening water composition having the foregoing composition is diluted with tap water or well water prior to use as dampening water. Tap water or well water generally contains ions such as calcium ions which exert adverse influences on printing and the presence thereof often causes contamination of printed matters. These problems can effectively be solved if the dampening water composition comprises a chelating agent.

Examples of preferred chelating agents include such an aminopolycarboxylic acid or a salts thereof as ethylenediaminetetraacetic acid and potassium or sodium salt thereof, diethylenetriamine-pentaacetic acid and potassium or sodium salt thereof, triethylenetetramine-hexaacetic acid and potassium or sodium salt thereof, hydroxyethyl ethylenediamine-triacetic acid and potassium or sodium salt thereof, nitrilotriacetic acid and potassium or sodium salt thereof, 1,2-diaminocyclohexane-tetraacetic acid and potassium or sodium salt thereof and 1,3-diamino-2-propanol tetraacetic acid and potassium or sodium salt thereof; and such an organophosphonic acid, phosphonoalkane tricarboxylic acid or salts thereof as 2-phosphonobutane-tricarboxylic acid-1,2,4 and potassium or sodium salt thereof, 2-phosphonobutane-tricarboxylic acid-2,3,4 and potassium or sodium salt thereof, 1-phosphonoethane-tricarboxylic acid-2,2,2 and potassium or sodium salt thereof, 1-hydroxyethane-1,1-diphosphonic acid and potassium or sodium salt thereof and aminotri (methylene-phosphonic acid) and potassium or sodium salt thereof.

Organic amine salts of the foregoing chelating agents may be used effectively instead of potassium and sodium salts thereof. These chelating agents should be selected so that they are stably present in the dampening water and exhibit no printing inhibitory effect. These chelating agents are used in the dampening water composition in an amount ranging from 0.001 to 3% by weight, preferably 0.01 to 1% by weight on the basis of the total weight of the composition.

Moreover, the dampening water composition of the invention may comprise other additives such as preservatives and coloring agents, for instance, bezoic acid and derivatives thereof, phenol, formalin, sodium dehydroacetate or 4-isothiazolin-3-one. These preservatives and/or coloring agents may be used in an amount of 0.001 to 1% by weight based on the total weight of the composition.

Furthermore, the dampening water composition of the invention may contain such a corrosion inhibiting agent as magnesium nitrate, zinc nitrate, calcium nitrate, sodium nitrate, potassium nitrate, lithium nitrate and ammonium nitrate; such a film hardening agent as an aluminum compound; such an organic solvent as a cyclic ether, for instance, 4-butyrolactone, benzyl alcohol, ethylene glycol monophenyl ether, ethyl alcohol and n-propyl alcohol; such a water-soluble surface active organometallic compound as those disclosed in J.P. KOKAI No. 61-193893; and a silicone type anti-foaming agent, in an amount of 0.0001 to 1% by weight based on the total weight of the dampening water composition.

The dampening water composition of the invention may further comprise a small amount of at least one surfactant. Examples of anionic surfactants suitably used in the composition include fatty acid salts, abietic acid salts, hydroxyalkanesulfonic acid salts, alkanesulfonic acid salts, dialkyl sulfosuccinate salts, linear alkyl benzenesulfonate salts, branched alkyl benzenesulfonate salts, alkyl naphthalenesulfonate salts, alkylphenoxy polyoxyethylenepropylsulfonate salts, polyoxyethylene alkylsulfophenyl ether salts, sodium salt of N-methyl-N-oleyltaurine, disodium salt of N-alkylsulfosuccinic acid amide, petroleum sulfonic acid salts, sulfated castor oil, sulfated tallow, sulfuric acid ester salts of fatty acid alkyl ester, alkylsulfate ester salts, polyoxyethylene alkyl ether sulfuric acid ester salts, fatty acid monoglyceride sulfuric acid ester salts, polyoxyethylene alkylphenyl ether sulfuric acid ester salts, polyoxyethylene styrylphenyl ether sulfuric acid ester salts, alkylphosphate ester salts, polyoxyethylene alkyl ether phosphoric acid ester salts, polyoxyethylene alkylphenyl ether phosphoric acid ester salts, partially saponified styrene-maleic anhydride copolymers, partially saponified olefin-maleic anhydride copolymers and condensates of naphthalene sulfonic acid salt and formalin. Among these, particularly preferred are dialkylsulfosuccinic acid salts, alkylsulfate ester salts and alkylnaphthalenesulfonic acid salts.

Examples of non-ionic surfactants suitably used in the dampening water composition of the invention include polyoxyethylene alkyl ethers, polyoxyethylene alkylphenyl ethers, polyoxyethylene polystyrylphenyl ethers, polyoxyethylene polyoxypropylene alkyl ethers, partial esters of glycerin-fatty acids, partial esters of sorbitan-fatty acids, partial esters of pentaerythritol-fatty acids, propylene glycol monofatty acid ester, partial esters of sucrose-fatty acids, partial esters of polyoxyethylene sorbitan fatty acids, partial esters of polyoxyethylene sorbitol fatty acids, polyethylene glycol fatty acid esters, partial esters of polyglycerin fatty acids, castor oils modified with polyoxyethylene, partial esters of polyoxyethylene glycerin fatty acids, fatty acid diethanolamides, N,N-bis-2-hydroxyalkylamines, polyoxyethylene-alkylamines, triethanolamine fatty acid ester, polyoxyethylene-polyoxypropylene block copolymers and trialkylamine oxides. Particularly preferred are polyoxyethylene alkylphenyl ethers and polyoxyethylene-polyoxyproplene block copolymers among others.

Finally, examples of amphoteric surfactants or cationic surfactants useful in the invention include alkylimidazolines, alkylamine salts, quaternary ammonium salts, polyoxyethylene alkylamine salts and polyethylene polyamine derivatives.

These surfactants may be used alone or in combination and the amount thereof to be incorporated in the dampening water composition is not more than 3% by weight taking the foaming into consideration and preferably not more than 1% by weight based on the total weight of the composition.

The dampening water composition of this invention may be applied to a variety of lithographic printing plates, in particular it is suitably applicable to the lithographic printing plates obtained by imagewise exposing, to light, a presensitized plate which comprises an aluminum substrate provided thereon with a light-sensitive layer (generally referred to as "PS plate") and then developing the same. Examples of preferred PS plates include those composed of an aluminum substrate provided thereon with a light-sensitive layer which comprises a mixture of shellac and a diazo resin (a salt of a condensate of p-diazodiphenylamine and p-formaldehyde) as disclosed in U.K. Patent No. 1,350,521; negative working type PS plates composed of an aluminum substrate provided thereon with a light-sensitive layer which comprises a mixture of a diazo resin and a polymer mainly comprising repeating units derived from hydroxyethyl methacrylate or hydroxyethyl acrylate monomer as disclosed in U.K. Patent Nos. 1,460,978 and 1,505,739; and positive working PS plates composed of an aluminum substrate provided with a light-sensitive layer which comprises a mixture of o-quinonediazide light-sensitive compound and a novolak type phenol resin as disclosed in J.P. KOKAI No. 50-125806.

The aforementioned compositions for forming a light-sensitive layer may optionally comprise alkali-soluble resins in addition to the foregoing alkali-soluble novolak type resins. Examples of such resins are styrene-acrylic acid copolymer, methyl methacrylate-methacrylic acid copolymer, alkali-soluble polyurethane resins, alkali-soluble vinyl resins as disclosed in J.P. KOKOKU No. 52-28401, and alkali-soluble polybutyral resins.

Moreover, preferred examples of PS plates further include PS plates composed of an aluminum substrate provided thereon with a light-sensitive layer of photo-cross-linkable photopolymers as specifically disclosed in U.S. Pat. No. 3,860,426; PS plates composed of an aluminum substrate provided thereon with a light-sensitive layer of photopolymerizable photopolymer composition as disclosed in U.S. Pat. Nos. 4,072,528 and 4,072,527; and PS plates composed of an aluminum substrate provided thereon with a light-sensitive layer which comprises a mixture of an azide and a water-soluble polymer as disclosed in U.K. Patent Nos. 1,235,281 and 1,495,861.

The dampening water composition of this invention is in general diluted with water prior to use as dampening water. The dampening water composition of the invention makes it possible to perform printing using a small amount thereof without causing background contamination and oxidative contaminations, to provide good printed matters and to improve efficiency of printing operation and productivity. In addition, when it is used as dampening water, in particular in a printing press in which dampening water is continuously supplied, represented by Dahlgren dampening system, good printed matters can be obtained without using isopropyl alcohol. However, a small amount, for instance, 1 to 15% by weight of isopropyl alcohol may simultaneously be used without impairing quality of the printed matters.

As explained above in detail, the dampening water composition and the additive for lithographic printing of the present invention are not toxic, do not have a possibility of causing a fire and pollution of working atmosphere and, therefore, the use of a local exhaust installation is not necessary. Moreover, it is excellent in characteristics of dampening water such that it does not cause contamination of metering rolls, that it is excellent in bleeding properties, emulsifying properties and stability in continous processing and it has low foaming properties. Therefore, it makes the printing operation quite stable.

The dampening water composition and the additive for lithographic printing of the present invention will hereunder be explained in more detail with reference to the following non-limitative working Examples. In addition, the effects practically achieved will also be discussed in detail in comparison with Comparative Examples given below. In the following Examples and Comparative Examples, the term "%" means "% by weight", unless otherwise specified.

Example 1

| Solution A | |
|---|---|
| Component | Amount (p.b.w.) |
| Pure water | 837 |
| Citric acid | 20 |
| Ammonium secondary phosphate | 40 |
| Sodium nitrate | 20 |
| Aqueous solution of gum arabic (14° Be') | 80 |
| 37% Formalin | 3 |

*"p.b.w." means "parts by weight".

An aqueous solution A having the foregoing composition was prepared as a desensitizing solution and was diluted 100 times with water. Then, 2-methyl-1-pentanol to which 1 to 4 moles of ethylene oxide had been added (Additive (i)) was added to the diluted solution in an amount of 1% by weight based on the diluted solution to thus prepare dampening water. On the other hand, a PS plate (anodized, multigrained positive working type PS plate; available from Fuji Photo Film Co., Ltd. under the trade name of FPS-II) was imagewise exposed to light, was developed and gummed-up using PS automatic developing machine 800 EII, a developer DP-4 for positive working type PS plate (diluted 8 times with water) and a finisher FP for positive working type PS plate (diluted 2 times with water) (all of these being available from Fuji Photo Film Co., Ltd.) to obtain a lithographic printing plate. The resultant plate was set up on an offset printing press of Dahlgren dampening system, Harris. Aurelia 125 (available from MARUBENI. HARRIS PRINTING PRESS MANUFACTURING COMPANY), the foregoing dampening water and an ink (available from DAINIPPON INK CO., LTD. under the trade name of Apex G Magenta Type-S) were charged to the press and printing opration was performed to examine the dampening water on the following points.

a. Contamination of Metering Roll: Degree of contamination of metering rolls for sending water up due to adhesion of the ink was estimated according to the following three-stage evaluation:
   Good: A
   Slightly Contaminated: B
   Contaminated: C
b. Bleed Properties: Using an ink (available from DAINIPPON INK CO., LTD. under the trade name of Apex G Magenta Type-S), the operation of the printing press was stopped after printing 5,000 and 10,000 sheets of printed matters, and at these stages, the degree of the non-image area which was blurred with the ink from the image areas was estimated according to the following three stages evaluation:
   There is no portion blurred with ink: A
   There is some portions blurred with ink: B
   There are a lot of portions blurred with ink: C
c. Emulsifying Properties: After printing 10,000 sheets of printed matters, the emulsified state of the ink on a roll for kneading ink was examined and estimated according to the following three-stage evaluation:
   Good: A
   Not so good: B
   Bad: C
d. Continuous Stability: 10,000 sheets of printed matters were obtained using pure water as dampening water to obtain the amount of dampening water which did not cause contamination (minimum amount of water sent up) and printing was performed using various dampening water in the minimum sent up amount to determine the number of printed matters obtained till contamination was caused.
   More than 10,000: A
   10,000 to 3,000: B
   Less than 3,000: C The dampening water of this Example was examined on these properties and was found that it was excellent in all the properties examined (a) to (d) and good printed matters were obtained.

COMPARATIVE EXAMPLE 1

When dampening water free of 2-methyl-1-pentanol to which 4 moles of ethylene oxide had been added (Additive (i)) was used, control of the amount of water was very difficult. More specifically, sending up of water was uneven, only contaminated printed matters were obtained at usual water level and such contamination could not sufficiently be eliminated even if the water level was established at the upper limit of this printing press and so-called ink to water log phenomenon was generated, in other words, a sufficient amount of ink was not adhered to a part of the image areas. Moreover, results on other properties (a), (b) and (d) were not all satisfied.

EXAMPLES 2 TO 5 AND COMPARATIVE EXAMPLE 2

As in Example 1, a desensitizing gum solution B having the following composition was prepared, diluted 100 times with water and additives (ii) to (v) and a known additive (vi) each was added thereto in an amount of 1% to obtain 5 kinds of dampening water and qualities of these dampening water were likewise estimated.

| Desensitizing Solution B | |
|---|---|
| Component | Amount (p.b.w.) |
| Pure water | 876 |
| Carboxymethyl cellulose (available from DAIICHI KOGYO YAKUHIN CO., LTD. under the trade name of Cellogen 6A) | 20 |
| Magnesium nitrate | 30 |
| Sodium hexametaphosphate | 30 |
| Diethylene glycol | 20 |
| 85% Phosphoric acid solution | 20 |
| 4-Isothiazolin-3-one | 2 |
| 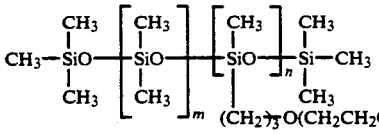 | 2 |

(m, n = 1~5; p = 20~30)

Example 2: Additive (ii): adduct of 2-ethylbutyl alcohol and 1 to 5 moles of ethylene oxide;

Example 3: Additive (iii): adduct of 2-ethylhexyl alcohol and 1 to 6 moles of ethylene oxide;

Example 4: Additive (iv): adduct of 3-methoxybutyl alcohol, 1 to 6 moles of ethylene oxide and 1 to 4 moles of propylene oxide;

Example 5: Additive (v): adduct of 2-methyl-2,4-pentanediol and 1 to 5 moles of ethylene oxide;

Comparative Example 2: Additive (vi): 2-ethyl-1,3-hexanediol.

The results obtained are listed in Table I given below. As seen from the results listed in Table I, the dampening water of Examples 2 to 5 showed excellent properties (a) contamination of the metering roll; (b) bleed properties; and (d) continuous stability compared with the dampening water of Comparative Example 2. Moreover, these dampening water of Examples 2 to 5 only slightly caused foaming even if they were pumped or stirred.

TABLE I

| Example No. | 2 | 3 | 4 | 5 | Comp. Ex. 2 |
|---|---|---|---|---|---|
| (a) Contamination of metering roll | B | A | A | A | C |
| (b) Bleed properties | A | A | B | A | C |
| (C) Emulsifying properties | A | B | B | B | B |
| (D) Continuous stability | B | A | A | A | C |

EXAMPLES 6 to 9 AND COMPARATIVE EXAMPLE 3

A desensitizing solution C having the following composition was prepared, then was diluted 100 times with water, additive (vii) or (viii) was added thereto in an amount of 1% or 3% each respectively to form 4 kinds of dampening water (Examples 6 to 9) and 10% by volume of isopropyl alcohol to form comparative dampening water (Comparative Example 3). The properties of these dampening water were estimated and were compared with those of Comparative Example 3.

| Component | Amount (p.b.w.) |
|---|---|
| Desensitizing Solution C | |
| Pure water | 928 |
| Sodium salt of acrylic acid/methacrylic acid (molar ratio = 70/30) copolymer | 10 |
| Sodium gluconate | 10 |
| Citric acid | 20 |
| 1-Hydroxyethane-1,1-diphosphonic acid (available from Mon Sant Chemical Company under the trade name of DEQUEST-2000) | 10 |
| Phenol | 2 |
| Additive (vii) | |
| Pure water | 23 |
| Adduct of 2,4-heptanediol and 1 to 4 moles of ethylene oxide | 70 |
| Carboxymethyl cellulose (available from DAIICHI KOGYO YAKUHIN CO., LTD. under the trade name of Cellogen BS) | 5 |
| 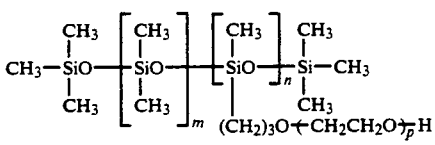 | 2 |

(m, n = 1~5; p = 1~5)

-continued

| Component | Amount (p.b.w.) |
|---|---|
| Additive (viii) | |
| Pure water | 10 |
| Adduct of 2,5-hexanediol and 1 to 5 moles of ethylene oxide | 80 |
| Aqueous solution of gum arabic (14° Be') | 5 |
| Sodium dehydroacetate | 5 |

A PS plate (anodized, multigrained negative working type PS plate; available from Fuji Photo Film Co., Ltd. under the trade name of FNS) was imagewise exposed to light, was developed and gummed-up using PS automatic developing machine 800 H, a developer DN-3C for negative working type PS plates (diluted 2 times with water) and a finisher FN-2 for negative working type PS plates (diluted 2 times with water) (all of these being available from Fuji Photo Film Co., Ltd.) to obtain a lithographic printing plate. Printing operation was carried out to estimate various properties of the resultant lithographic printing plate as in Examples 1 and 2. The results obtained are summarized in Table II below. All the dampening water of the present invention have properties almost identical with those of the dampening water containing 10% by volume of isopropyl alcohol.

(COMPARATIVE EXAMPLE 3)

TABLE II

| Example No. | 6 | 7 | 8 | 9 | Comp. Ex. 3 |
|---|---|---|---|---|---|
| Additive | (vii) | (vii) | (viii) | (viii) | isopropyl alcohol |
| Amount added (%) | 1 | 3 | 1 | 3 | 10% by volume |
| (a) Contamination of metering roll | A | A | A | A | A |
| (b) Bleed properties | B | A | B | A | A |
| (c) Emulsifying properties | A | B | A | B | A |
| (d) Continuous stability | B | A | B | A | B |

EXAMPLE 10

2-Ethyl-1,3-hexanediol to which 1 to 4 moles of ethylene oxide had been added (Additive (ix)) was added to the diluted solution A (diluted 100 times with water) in an amount of 1% based on the diluted solution to thus prepare dampening water. The printing operation was performed to examine properties of the dampening water in the same manner as in Example 1.

The dampening water of this Example was examined on these properties and was found that it was excellent in all the properties examined (a) to (d) and good printed matters were obtained.

COMPARATIVE EXAMPLE 4

When dampening water free of 2-ethyl-1,3-hexanediol to which 3 moles of ethylene oxide had been added (additive (ix)) was used, control of the amount of water was very difficult. More specifically, sending up of water was uneven, only contaminated printed matters were obtained at a usual water level and such background contamination could not sufficiently be eliminated even if the water level was established at the upper limit of this printing press and so-called ink to water log phenomenon (phenomenon that the ink was not adhered to image areas) was occurred, in other words, a sufficient amount of ink was not adhered to a part of the image areas. Moreover, other properties (a), (b) and (d) were also insufficient.

EXAMPLES 11 TO 14 AND COMPARATIVE EXAMPLE 5

As in Example 1, the desensitizing solution B was diluted 100 times with water and additives (x) to (xiii) and a known additive (xiv) each was added thereto in an amount of 1% to obtain 5 kinds of dampening water and qualities of the dampening water were likewise estimated.

Example 11: Additive (x): adduct of 2-ethyl-1,3-hexanediol and 1 to 4 moles of ethylene oxide;

Example 12: Additive (xi): adduct of 2-ethyl-1,3-hexanediol and 1 to 6 moles of ethylene oxide;

Example 13: Additive (xii): adduct of 2-ethyl-1,3-hexanediol and 2 to 8 moles of ethylene oxide Example 14: Additive (xiii): adduct of 2-ethyl-1,3-hexanediol, 1 to 6 moles of ethylene oxide and 1 to 4 moles of propylene oxide;

Comparative Example 5: Additive (xiv): 2-ethyl-1,3-hexanediol.

The results obtained are listed in Table III given below. As seen from the results listed in Table III, the dampening water of Examples 11 to 14 showed excellent properties (a) contamination of the metering roll; (b) bleed properties; and (d) continuous stability compared with the dampening water of Comparative Example 5 containing additive (xiv). Moreover, the dampening water of Examples 11 to 14 only slightly caused foaming even if they were pumped or stirred.

TABLE III

| Example No. | 11 | 12 | 13 | 14 | Comp. Ex. 5 |
|---|---|---|---|---|---|
| (a) Contamination of metering roll | B | A | A | A | C |
| (b) Bleed properties | A | A | B | A | C |
| (C) Emulsifying properties | A | A | B | B | B |
| (D) Continuous stability | B | A | A | A | C |

EXAMPLES 15 TO 18 AND COMPARATIVE EXAMPLE 6

The desensitizing solution C was diluted 100 times with water, additive (xv) or (xvi) was added thereto in an amount of 1% or 3% each respectively to form 4 kinds of dampening water (Examples 15 to 18) and 10% by volume of isopropyl alcohol to form comparative dampening water (Comparative Example 6). The properties of these dampening water were estimated and were compared with those of Comparative Example 6.

| Component | Amount (%) |
|---|---|
| Additive (xv) | |
| Pure water | 49.5 |
| Adduct of 2-ethyl-1,3-hexanediol and 1 to 5 moles of ethylene oxide | 50.0 |
| Carboxymethyl cellulose (available from DAIICHI KOGYO YAKUHIN CO., LTD. under the trade name of Cellogen BS) | 0.3 |

-continued

| Component | Amount (%) |
|---|---|
| 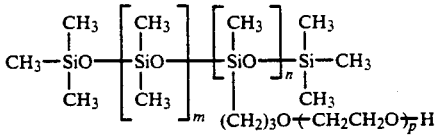 (m, n = 1~5; p = 1~5) | 0.2 |
| Additive (xvi) | |
| Pure water | 49.0 |
| Adduct of 2-ethyl-1,3-hexanediol, 1 to 6 moles of ethylene oxide and 1 to 4 moles of propylene oxide | 50.0 |
| Gum arabic | 0.5 |
| Sodium dehydroacetate | 0.5 |

Printing operation was performed to examine the properties of the dampening water in the same manner as in Examples 6 to 9.

TABLE IV

| Example No. | 15 | 16 | 17 | 18 | Comp. Ex. 6 |
|---|---|---|---|---|---|
| Additive | (xv) | (xv) | (xvi) | (xvi) | isopropyl alcohol |
| Amount added (%) | 1 | 3 | 1 | 3 | 10% by volume |
| (a) Contamination of metering roll | A | A | A | A | A |
| (b) Bleed properties | B | A | B | A | A |
| (c) Emulsifying properties | A | A | A | A | A |
| (d) Continuous stability | B | A | A | A | B |

What is claimed is:

1. A method of lithographic printing comprising contacting a lithographic printing plate having an ink-receptive oleophilic area and a hydrophilic area on the printing surface of the plate with an ink and dampening water during printing, wherein said dampening water comprises 0.1 to 5% by weight of at least one member selected from the compounds represented by the following Formula (I):

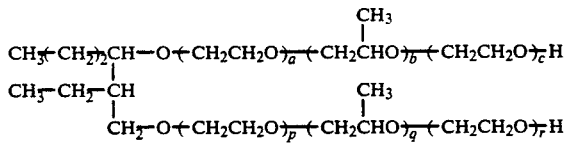

in Formula (I), the sum of a, b, c, p, q and r is an integer ranging from 1 to 10 and each of these is an integer of 0 to 10.

2. The method of claim 1, wherein the sum of a, c, p and r is larger than the sum of b and q.

3. A method of claim 1, wherein each of b and q is 0.

4. A method of claim 1 wherein the dampening water further comprises at least one water-soluble polymer selected from the group consisting of gum arabic, dextrin, enzyme-modified dextrin, hydroxypropylated enzyme-modified dextrin, carboxymethylated starch, starch phosphate, octenyl succinated starch, alginates, carboxymethyl cellulose, carboxyethyl cellulose, hydroxyethyl cellulose, methyl cellulose, polyvinyl alcohol and derivatives thereof, polyvinyl pyrrolidone, polyacrylamide and copolymers thereof, polyacrylic acid and copolymers thereof, vinyl methyl ether/maleic anhydride copolymer and vinyl acetate/maleic anhydride copolymer.

5. A method of claim 4 wherein the amount of the water-soluble polymer ranges from 0.0001 to 5% by weight on the basis of the composition.

6. A method of claim 1 wherein pH of the composition is adjusted to 3 to 6.

7. A method of claim 1 wherein pH of the composition is adjusted to 7 to 11.

8. A method of claim 1 wherein the dampening water further comprises at least one wetting agent selected from the group consisting of glycerin, ethylene glycol, propylene glycol, butylene glycol, pentanediol, hexylene glycol, diethylene glycol, triethylene glycol, tetraethylene glycol, sorbitol and pentaetrythritol.

9. A method of claim 8 wherein the amount of the wetting agent is not more than 2.0% by weight on the basis of the composition.

10. A method of claim 1 wherein the dampening water further comprises at least one chelating agent selected from the group consisting of aminopolycarboxylic acid and salts thereof: organophosphoric acid, phosphonoalkane tricarboxylic acids and salts thereof; and organic amine salts of the foregoing acids.

11. A method of claim 10 wherein the amount of the chelating agent ranges from 0.001 to 3% by weight on the basis of the composition.

12. A method of claim 1 wherein the dampening water further comprises preservatives, coloring agents, corrosion inhibiting agents, film hardening agents, organic solvents, water-soluble surface active organometallic compounds and/or silicone type antifoaming agents, in an amount of 0.0001 to 1% by weight on the basis of the composition.

13. A method of claim 1 wherein the dampening water further comprises at least one surfactant.

14. A method of claim 13 wherein the amount of the surfactant is not more than 3% by weight on the basis of the composition.

* * * * *